US007311941B2

(12) United States Patent
Cesiro et al.

(10) Patent No.: US 7,311,941 B2
(45) Date of Patent: Dec. 25, 2007

(54) PROCESS FOR IMPROVED ADHESIVE APPLICATION

(75) Inventors: Luca Cesiro, Pescara (IT); Rodrigo Rosati, Francavilla al Mare (IT); Sandro Breda, Pescara (IT); Andrea Branca, Pescara (IT); Osvaldo Mancini, Pescara (IT)

(73) Assignee: The Procter & Gamble Company, Cincinnati, OH (US)

( * ) Notice: Subject to any disclaimer, the term of this patent is extended or adjusted under 35 U.S.C. 154(b) by 180 days.

(21) Appl. No.: 10/915,741

(22) Filed: Aug. 11, 2004

(65) Prior Publication Data

US 2005/0037144 A1 Feb. 17, 2005

(30) Foreign Application Priority Data

Aug. 11, 2003 (EP) ..... 03102498

(51) Int. Cl.
*B05D 1/00* (2006.01)

(52) U.S. Cl. ..... 427/208.2; 427/207.1

(58) Field of Classification Search ..... 427/208.2, 427/207.1

See application file for complete search history.

(56) References Cited

U.S. PATENT DOCUMENTS

| | | | | |
|---|---|---|---|---|
| 2,207,426 | A * | 7/1940 | Bailey | 264/478 |
| 3,937,778 | A | 2/1976 | Tanaka | |
| 4,329,380 | A | 5/1982 | Johansen et al. | |
| 5,378,472 | A | 1/1995 | Muzzarelli | |
| 6,463,633 | B1 | 10/2002 | Hilston et al. | |
| 2002/0098282 | A1 | 7/2002 | Suzuki | |
| 2003/0062384 | A1 * | 4/2003 | McGuffey | 222/109 |
| 2003/0109628 | A1 * | 6/2003 | Bonfanti et al. | 524/507 |

FOREIGN PATENT DOCUMENTS

| | | |
|---|---|---|
| DE | 100 30 520 | 1/2002 |
| EP | 0 072 679 B1 | 4/1986 |
| EP | 0 745 433 B1 | 6/2001 |
| EP | 0 737 692 B1 | 1/2002 |
| EP | 1 402 905 A1 | 3/2004 |
| GB | 2134420 A | 8/1984 |
| WO | WO 87/07618 A1 | 12/1987 |

OTHER PUBLICATIONS

Kirk-Othmer Encyclopedia of Chemical Technology, 4th Ed., 1991, p. 461.*

PCT International Search Report dated Nov. 29, 2004.

* cited by examiner

*Primary Examiner*—Fred J. Parker
(74) *Attorney, Agent, or Firm*—James E. Oehlenschlager; Michael S. Kolodesh; David M. Weirich

(57) ABSTRACT

The present invention relates to a method of applying molten hot melt adhesives, which comprise volatile material, at a constant adhesive mass flow rate. According to the method of the present invention the molten hot melt adhesive containing volatile material is applied under raised pressure. Specifically, the present invention is useful in the field of producing absorbent articles for personal hygiene.

13 Claims, 1 Drawing Sheet

PROCESS FOR IMPROVED ADHESIVE APPLICATION

FIELD OF INVENTION

The present invention relates to a method of applying molten hot melt adhesives, which comprise volatile material, at a constant adhesive mass flow rate. According to the method of the present invention the molten hot melt adhesive containing volatile material is applied under raised pressure.

Specifically, the present invention is useful in the field of producing absorbent articles for personal hygiene.

BACKGROUND OF THE INVENTION

There are numerous references relating to ways of applying hot-melt adhesives, i.e. adhesives being applied at raised temperatures in their molten state, to substrates. Examples are SE 374,489; GB 2,134,420 or EP 745,433. In these and other prior art references adhesive application techniques are described where adhesives are provided onto substrates by printing, spraying, slot- or curtain coating and the like.

Recent developments in adhesive formulation technology have resulted in more and more hot-melt adhesives, which contain significant amounts of relatively volatile materials. Examples are hot-melt adhesives containing superabsorbents, in particular materials with high absorption capacity towards aqueous fluids. These superabsorbents, typically present in the adhesive in particle form, are hygroscopic and therefore tend to accumulate water during storage of the adhesive from e.g. environmental air humidity. When such adhesives containing superabsorbent material are molten at raised temperatures for application onto absorbent articles, volatile materials that typically have boiling points lower than the application temperature of the hot-melt adhesive, in this example water, tend to evaporate and to form gas bubbles in the adhesive. These gas bubbles, however, are detrimental upon application of the adhesive. Usually, for very tightly controlled application of the adhesive, which is an absolute requirement in high speed manufacturing processes like those of absorbent articles such as diapers or feminine hygiene articles, the adhesive is delivered to the applicator means through volumetric pumps. These pumps supply a defined amount of adhesive per every revolution. However, if there are gas bubbles present in the adhesive, the actual amount of adhesive supplied by the volumetric pumps will be uneven and thus uncontrollable due to the high variation of density of the bubbles-containing adhesive. This then results in quality issues with the so-produced absorbent articles due to uneven adhesive application resulting in uneven bonding between their components. This ultimately might affect the overall absorbency capabilities of the absorbent article. Therefore conventional adhesive application methods all fail to provide the required control of the adhesive application for those particular adhesives.

It has also been observed that the particle size of the superabsorbent particles suspended in the hot melt adhesive has a major influence on this problem. The smaller the superabsorbent particles are the higher is the amount of gas bubbles generated because of the higher effective particle surface.

In view of the prior art cited it is the object of the present invention to provide a method for applying hot-melt adhesives containing volatile material, said volatile material evaporating at the application temperature of the adhesive, which method allows very constant pumping of the amount of molten hot-melt adhesive from a storage tank per time. In other words, a method for applying volatiles-containing hot-melt adhesives is needed, which allows to pump molten hot melt adhesive at a constant mass flow rate over a certain temperature range.

SUMMARY OF THE INVENTION

The present invention solves the above-stated problem by providing a method for application of hot-melt adhesives, wherein the molten hot-melt adhesive is pumped free of gas bubbles originating from the volatile material contained in said adhesive. Thus, the density of the molten adhesive pumped is kept constant, which allows pumping the molten adhesive at a constant mass flow rate in a range of temperature. This is achieved by melting and pumping the hot-melt adhesive under raised pressure, by which the formation of gas bubbles originating from volatile material is reliably inhibited.

DETAILED DESCRIPTION OF THE INVENTION

Figure 1:
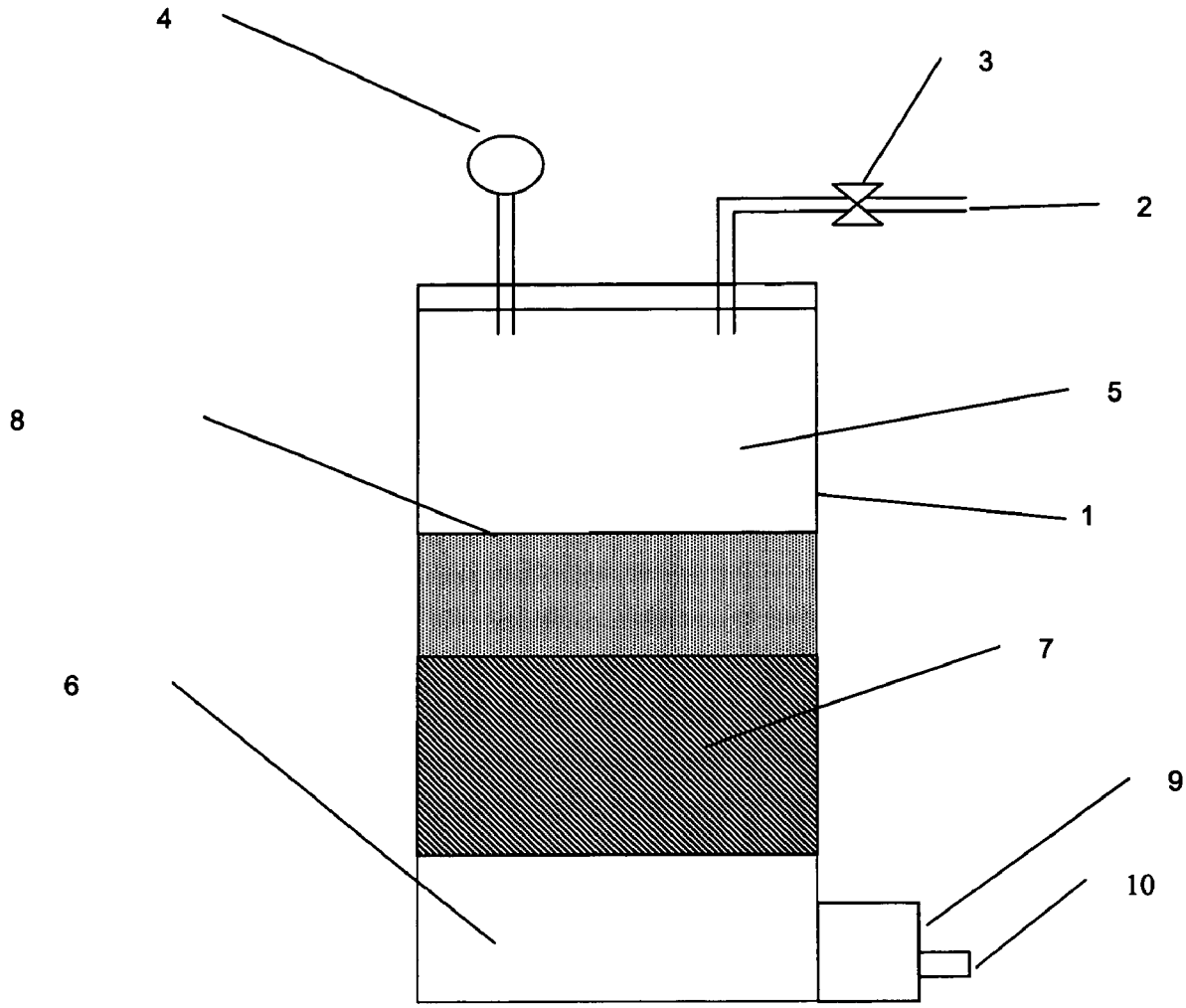
FIG. 1 shows a scheme for illustrating the key components of the application process of the present invention.

The term 'absorbent article' is used herein in a very broad sense including any article being able to receive and/or absorb and/or contain and/or retain fluids and/or exudates, especially bodily fluids/bodily exudates. The absorbent article, which is referred to in the present invention typically comprises a fluid pervious topsheet as the wearer-facing layer, a fluid impervious backsheet as the garment-facing layer that is preferably water vapour and/or gas pervious and an absorbent core comprised there between. Furthermore, absorbent articles in the context of the present invention are provided with a means for their attachment to the user's garment, in particular with an adhesive. Particularly preferred absorbent articles in the context of the present invention are disposable absorbent articles. Typical disposable absorbent articles according to the present invention are absorbent articles for personal hygiene, such as feminine care articles like sanitary napkins and panty liners; baby care articles like baby diapers; incontinence pads and perspiration pads like underarm sweat pads or hat bands. Latest developments have resulted in absorbent articles with absorbent cores comprising or even completely consisting of adhesives, particularly hot-melt adhesives, containing superabsorbents.

By 'body fluid' it is meant herein any fluid produced by the human body including for instance perspiration, urine, blood, menstrual fluids, vaginal secretions and the like.

The term 'disposable' is used herein to describe articles, which are not intended to be laundered or otherwise restored or reused as an article (i.e. they are intended to be discarded after a single use and preferably to be recycled, composted or otherwise disposed of in an environmentally compatible manner).

'Room temperature' as used herein refers to a temperature of 20° C.

'Atmospheric pressure' as used herein refers to an air pressure of 1 bar.

'Hot-melt adhesive' as used herein refers to adhesives, which are applied to their substrates at temperatures, which are significantly higher than room temperature. Usually, hot-melt adhesives are constituted of thermoplastic material, which is solid at room temperature and only becomes liquid and/or extrudable and thus applicable at raised temperatures. For applying hot-melt adhesives they are heated to their application temperature, thereby they liquefy. The temperature at which the molten hot-melt adhesive is handled in and supplied by suitable application equipment is referred to as its 'application temperature'. Conventionally, the application temperature of hot-melt adhesives are above 65° C. and typically range from 100° C. to 200° C., more typically from 120° C. to 180° C. After application to the substrate the hot-melt adhesive cools and solidifies again. By this the adhesive bond is established. Hot melt adhesives typically can be melted and re-solidified a number of times without excessive degradation of the thermoplastic properties. Hot-melt adhesives in the context of the present invention, their components and specific examples therefore are disclosed for instance in co-pending European patent application serial number 2021368.2 of the same applicant.

The hot-melt adhesive according to the present invention comprises as an essential element a polymeric base material. Typically, the hot-melt adhesive according to the present invention comprises from 5% to 99%, preferably 10% to 90%, more preferably from 30% to 70%, most preferably from 40% to 60% by weight of the total hot-melt adhesive of a polymeric base material. Any polymeric base material known to the skilled person and used in hot-melt adhesives for the construction of absorbent articles, such as feminine care absorbent articles (e.g. sanitary napkins, panty liners or incontinence articles) or baby care absorbent articles (e.g. diapers) can be used herein.

The polymeric base materials for use herein comprise from 5% to 99%, preferably 10% to 90%, more preferably from 30% to 70%, most preferably from 40% to 60% per weight of thermoplastic polymers as an essential element. A variety of different thermoplastic polymers are suitable for use herein. Exemplary thermoplastic polymers for use with the present invention are block copolymers, amorphous and crystalline polyolefins including homogeneous and substantially linear ethylene/alpha-olefin interpolymers, interpolymers of ethylene such as ethylene-vinyl-acetate (EVA), ethylene-methyl-acrylate (EMA) and ethylene n-butyl acrylate (EnBa) and mixtures thereof. Specific examples for each of the aforementioned classes of thermoplastic polymers are given in co-pending European patent application serial number 2021368.2 of the same applicant.

The polymeric base materials for use herein preferably furthermore comprise from 5% to 90%, preferably 10% to 85%, more preferably from 15% to 70%, most preferably from 30% to 65% by weight of suitable compatible plasticizers. Suitable 'plasticizers' for use in the present invention generally will include any conventional plasticizers which decrease hardness and modulus, enhance pressure sensitive tack and reduce melt and solution viscosity. Specific examples for suitable compatible plasticizers are given in co-pending European patent application serial number 2021368.2 of the same applicant.

The polymeric base material for use in the hot-melt adhesive according to the present invention optionally also comprises from 0% to 100%, preferably 1% to 30%, more preferably from 5% to 20%, most preferably from 8% to 12% by weight of tackifying resins. As used herein, the term 'tackifying resin' means any compound being useful to impart tack to the polymeric base material. ASTM D1878-61T defines tack as "the property of a material which enables it to form a bond of measurable strength immediately on contact with another surface". Specific examples for suitable tackifying resins are given in co-pending European patent application serial number 2021368.2 of the same applicant.

The polymeric base material for use in the hot-melt adhesive according to the present invention optionally also comprises from 0.1% to 10%, preferably 0.2% to 5%, more preferably from 0.5% to 2%, most preferably from 0.75% to 1.5% by weight of anti-oxidants. Suitable 'anti-oxidants' for use in the present invention include any conventional anti-oxidants, and are preferably hindered phenols such as for example Ethanox 330™ 1,3,5-trimethyl-2,4,6-tris(3,5-di-tert-butyl-4-hydroxybenzyl) benzene which is commercially available from the Ethyl Corporation. Other examples for suitable anti-oxidants are hindered phenolics (e.g., Irganox 1010, Irganox 1076, Irganox B 225).

The polymeric base material for use in hot-melt adhesive according to the present invention optionally also comprises surfactants. Suitable 'surfactants' for use herein are additives that reduce the surface tension and/or contact angle of the polymeric base material. Surfactants are useful in amounts ranging from about 0% to about 25% by weight and preferably from about 5% to about 15 % by weight, with respect to the total weight of the polymeric base material. Suitable surfactants include nonionic, anionic, and silicone surfactants. Specific examples for suitable surfactants are given in co-pending European patent application serial number 2021368.2 of the same applicant.

Other optional components of the polymeric base material for use herein include anti-ultraviolets, dyes, antibacterials, odour adsorbing materials, perfumes, pharmaceuticals, and mixtures thereof, which may be present within the polymeric base material at a level of up to 10% by weight of the polymeric base material.

The hot melt adhesive according to the present invention preferably comprises as an optional highly preferred element particles of superabsorbent material. Preferably, the hot melt adhesive comprises from 1% to 95%, preferably from 10% to 90%, more preferably from 30% to 70% and most preferably from 40% to 60% by weight of the total hot melt adhesive of particles of superabsorbent material. Any superabsorbent material known to the skilled person and used in absorbent articles, such as feminine care absorbent articles (e.g. sanitary napkins, panty liners or incontinence articles) or baby care absorbent articles (e.g. diapers) can be used herein.

'Superabsorbent material' as used herein means material having a strong tendency to absorb fluids, particularly water. Typical examples are polyacrylates such as those currently used in the absorbent cores of diapers or sanitary napkins. Superabsorbent material as used herein means materials, which are capable of absorbing at least five times of their weight of water or aqueous liquids. Furthermore, superabsorbent materials herein are 'hygroscopic' that means they have the tendency to bind water from their adjacent environment. This particularly applies to humidity, e.g. from environmental air. Due to this hygroscopic property the superabsorbents contained in the hot-melt adhesive accumulate water upon storage of said adhesive. Typically, as an average, the superabsorbent materials contained in hot-melt adhesives accumulate from 1 to 10%, most typically about 5% by weight of the superabsorbent of water during the production phase of the adhesive. Preferred superabsorbent materials are anionic absorbent gelling material as well as cationic absorbent material, such as chitin, chitosan or chitosan compounds, or combinations of anionic and cationic superabsorbent material. Particularly preferred superabsorbent materials for use herein are anionic absorbent gelling materials, i.e., absorbent gelling materials, which are predominantly negatively charged. These absorbent gelling materials can be any material having superabsorbent properties in which the functional groups are anionic, namely sulphonic groups, sulphate groups, phosphate groups or carboxyl groups. Preferably the functional groups are carboxyl groups. Particularly preferred anionic absorbent gelling materials for use herein are synthetic anionic absorbent gelling materials. Generally, the functional groups are attached to a slightly cross-linked acrylic base polymer. Superabsorbent materials for use according to the present invention can be made by polymerisation of ethylenically unsaturated monomers. Examples of ethylenically unsaturated monomers are acrylic acid, methacrylic acid, crotonic acid, maleic acid and its anhydride, fumaric acid, itaconic acid, and 2-(meth)acryloylethanesulfonic acid, and 2-(meth) acryloylpropanesulfonic acid, and 2-(meth)acrylamido-2-methylpropanesulfonic acid, vinylsulfonic acid, styrenesulfonic acid and the like and their salts; monomers containing nonionic hydrophilic substituents such as (meth) acrylamide, N-substituted (meth)acrylamides, 2-hydroxyethyl (meth)acrylate, 2-hydroxypropyl (meth)acrylate, methoxypolyethylene glycol (meth)acrylate, polyethylene glycol (meth)acrylate and the like; monomers of cationic character such as N,N'-dimethylaminoethyl (meth)acrylate, N,N'-diethylaminoethyl (meth)acrylate, N,N',N,N'-diethylaminopropyl (meth)acrylate, N,N'-dimethylaminopropyl (meth)acrylamide, and the like and their quartary salts. The polymers of those monomers can be used alone or mixtures of the polymers two or more of those monomers can be used as well. Copolymers of these monomers can also be used. Especially preferred polymers for use as superabsorbent material are cross-linked polyacrylates, hydrolyzed acrylonitrile grafted starch, polyacrylates grafted starch and isobutylene maleic anhydride copolymers.

Suitable crosslinking agents for facilitating the crosslinking of the preferred absorbent gelling material for use as superabsorbent material are N,N'-methylene-bis(meth)acrylamide, N-methylol(meth)acrylamide, ethylene glycol (meth)acrylate, polyethylene glycol (meth)acrylate, propylene glycol (meth)acrylate, polypropylene glycol (meth) acrylate, glycerol tri(meth)acrylate, glycerol mono(meth) acrylate, polyfunctional metal salts of (meth)acrylic acid, trimethylolpropane tri(meth)acrylate, triallylamine, triallyl cyanulate, triallyl isocyanulate, triallyl phosphate, glycidyl (meth)acrylate. As examples of agents having reactive functional groups for example, in a case that a monomer has a carboxyl and/or carboxylate group, polyhydric alcohol derivatives such as ethylene glycol, diethylene glycol, triethylene glycol, tetraethylene glycol, polyethylene glycol, glycerol, polyglycerol, propylene glycol, diethanolamine, triethanolamine, polyoxypropylene, oxyethyleneoxypropylene block co-polymer, pentaerythritol, and sorbitol; polyglycidyl derivatives such as ethylene glycol diglycidyl ether, polyethylene glycol diglycidyl ether, glycerol polyglycidyl ether, diglycerol polyglycidyl ether, polyglycerol polyglycidyl ether, sorbitol polyglycidyl ether, pentaerythritol polyglycidyl ether, propylene glycol diglycidyl ether, and polypropylene glycol diglycidyl ether; aziridine derivatives and related compounds such as 2,2-bishydroxymethylbutanol-tris (3-[1-aziridinyl) propionate], 1,6-hexamethylenediethylene urea, and diphenylmethane-bis-4,4'-N,N'-diethylene urea; haloepoxyl compounds such as epichlorohydrin and alpha-methylchlorohydrin; polyaldehydes such as glutar aldehyde and glyoxal; poly amine derivatives such as ethylene diamine, diethylene triamine, triethylene tetramine, tetraethylene pentamine, pentaethylene hexamine, and polyethylene hexamine; polyisocyanates such as 2,4-toluylenediisocyanate and hexamethylenediisocyanate; polyvalent metal salts such as aluminium chloride, magnesium chloride, calcium chloride, aluminium sulfate, magnesium sulfate, and calcium sulfate. Subject to consideration upon reactivity, these crosslinking agents can be used as a mixture of more than two, but it is usually preferable to use a crosslinking agent having polymerizable unsaturated groups.

The preferred, slightly cross-linked, hydrogel-forming absorbent gelling materials will generally be employed in their partially neutralized form. For purposes described herein, such materials are considered partially neutralized when at least 25 mole percent, and preferably at least 50 mole percent of monomers used to form the polymer are acid group-containing monomers, which have been neutralized with a salt-forming cation. Suitable salt-forming cations include alkali metal, ammonium, substituted ammonium and amines. This percentage of the total monomers utilized, which are neutralized acid group-containing monomers, is referred to as the "degree of neutralization". Typically, commercial absorbent gelling materials have a degree of neutralization somewhat from 25% to 90%.

Examples for cationic superabsorbent materials for use herein are chitin, chitosan, chitosan salts, such as chitosonium lactate or chitosonium pyrollidone carboxylate (as disclosed in WO-A-98/07618), modified chitosans as disclosed in WO-A-87/07618, U.S. Pat. No. 5,378,472 or EP-A-737,692, cross-linked chitosans, or mixtures thereof.

An exemplary hot-melt adhesive comprises (by weight):

a) from about 5% to about 99% of a polymeric base material, comprising a') from about 10% to about 50% of a block copolymer, a") from about 0% to about 50% of a tackifying resin; and b) from about 1% to about 95% of particles of superabsorbent material.

Another exemplary hot-melt adhesive comprises (by weight):

a) from about 5% to about 99% of a polymeric base material, comprising a') from about 10% to about 50% block copolymer, a") from about 0% to about 50% tackifying resin, a"') from about 10% to about 80% plasticizer, a"") from about 0% to about 2% antioxidant; and b) from about 1% to about 95% of particles of superabsorbent material.

'Volatile material' as used herein means materials having a boiling point below the application temperature of the hot melt adhesive at normal atmospheric pressure. The volatile material according to the present invention does not decompose or otherwise chemically react while heated from the storage temperature of the hot-melt adhesive to the application temperature of the hot-melt adhesive. A typical, non-limiting example of volatile material contained in a hot-melt adhesive is water. Water especially occurs in hot-melt adhesives containing superabsorbents with high water-absorption capacity, such as polyacrylates. These materials are hygroscopic and tend to bind water from the environment, e.g. air humidity.

'Adhesive tank' as used herein is a vessel, wherein the hot-melt adhesive is molten to its application temperature for being able to be applied to the target substrate. The base tank used in the present invention is a standard tank, as commonly known in the art. Examples are series MX3400 and MX4400 manufactured and supplied by Nordson. They are typically sold in a wide range of holding capacity and melt rate. Holding capacity typically ranges from about 10 to about 160 kg. There is also the option of increasing the holding capacity by about 10 kg up to about 115 kg with extended heated or unheated hoppers. Melting rate capacity typically ranges from about 5 kg/hour to about 120 kg/hour. Of course the actual melt rate depends not only on the heating power and melter design, but also on the characteristic specific heat, heat conducibility, density and viscosity of the adhesive. Standard tanks typically have a wide standard operating temperature range of 50 to 200° C. to meet diverse application requirements: optionally maximum temperature can be 250° C. Heated zones typically employ microprocessor-based PID temperature controllers and Ni 120 RTD, PT 100 or thermocouple sensors to maintain temperatures to within ±0.5 C of setpoint. Comprehensive temperature controllers feature digital temperature display over and undertemperature alarm settings with external alarm capability, overtempearture protection for tank, self-testing and error-message display. Also temperature setback (standby function) minimizes char formation and energy consumption during periods of inactivity. Heating capacity is typically designed accordingly with the holding capacity and the melt rate. Electrical power ranges from about 1.8 kW to about 20 kW. Melting is typically achieved with the melting grid and the hopper, whose design is such that it provides increased heated surface area contact to enhance melt rate. Some specific designs are available on the market such as dual melt zone to optimize melt rate and help prevent adhesive bridging. In this case a warm hopper maintains adhesive at low melt zone temperatures; grid and hopper melt zones are separate castings with an insulated barrier between castings to maintain temperature isolation. Lateral walls of the tank are typically insulated with flexible covers; optionally they can be heated. Walls and other internal passages in the tank are typically coated with durable antistick/antioxidation coatings, such as Impreglon®, to minimize char buildup. The tank is typically endowed with hydraulic features such as 1) feeding connection for external filling by drum melters, 20 return hose ports for application heads with external re-circulation, 3) drain valve for easy draining of the tank, 4) large-capacity filters to ensure removal of contaminants and avoid nozzle clogging, 5) air exhaust valve to get rid of the air in the system after the filter changes without removing the heated hose, 6) hose fitting under the unit, 7) pneumatic bypass to control the maximum hydraulic pressure and 8) pump shut-off valve for fast changing of pumps without draining the tank.

'Inert gas' as used herein means any material being gaseous at room temperature, which does not react with any component of the molten hot-melt adhesive. Typical examples are carbon dioxide or nitrogen. Although air cannot be regarded as completely inert under the conditions of hot melt adhesive application it has proven to be applicable for pressurizing the hot-melt adhesive herein, too. Thus, the term 'inert gas' herein also comprises air.

Usually hot-melt adhesives are molten for application in large adhesive tanks and delivered by a delivery means. Typically, the delivery means is a pump with volumetric pumps being particularly preferred for their well-defined pumping rate. Pumping capacity of such volumetric pumps ranges typically between 1 to 80 kg/hour. Systems can be matched to application requirements through a choice of pump sizes (e.g. 0.3, 2.4 or 7.8 $cm^3$ per revolution), multiple pumps (up to four), speed-reducer ratio (e.g. 10:1 and 20:1) or variable-speed AC drives. Each pump supports a single hose/applicator combination, with the exception of single and dual pump units, which handle a maximum of two hoses per pump. Individual metering gear pumps with separate drives and high rpm accuracy provide precise material output and control. The base principle of these volumetric pumps is that with every revolution of the pump shaft a definite amount of liquid enters the pump through the suction port. This liquid fills the spaces between the teeth of the rotors and the pump inner walls: therefore the pump will supply such volume of liquid at each revolution: if the speed of revolution is kept constant, the volumetric flow rate of the molten adhesive will be constant. However, the mass flow rate of the molten adhesive will vary with temperature due to the gas bubbles generated by the volatile material contained in the adhesive as long as the formation of those gas bubbles is not inhibited. This is also illustrated by the results of the test method disclosed herein.

'Volumetric flow rate' as used herein means the volume of molten hot melt adhesive, regardless if the adhesive contains gas bubbles or not, which is pumped by the delivery means, preferably a volumetric pump, in a certain time interval. Typically, the variation of the volumetric flow rate of a volumetric pump is ±5%.

'Mass flow rate' as used herein means the weight of molten hot melt adhesive, regardless if the adhesive contains gas bubbles or not, which is pumped by the delivery means, preferably a volumetric pump, in a certain time interval. While the volumetric flow rate will be more or less insensitive to the occurrence of gas bubbles in the adhesive, the mass flow rate will vary significantly with the occurrence of gas bubbles, which again is influenced by temperature. This is further illustrated by the results of the test method disclosed herein.

An apparatus for the process according to the present is illustrated in FIG. 1. As outlined before, during the heating step gas bubbles are generated if the adhesive contains volatile material. Therefore the density will change over time due to the different volume occupied by gas bubbles as function of temperature. Such density variations cause mass flow rate variations of the molten adhesive if the speed of revolution is kept constant; such mass flow rate, and consequently amount applied onto the product, can have variations even of 100% over time. The present invention avoids the generation of gas bubbles in the adhesive and thus adhesive mass flow arte variations by pressurizing the adhesive tank (1) to a pressure above normal atmospheric pressure by pumping inert gas into the adhesive tank (1). The pressure is typically 0.5 bar, preferably 0.75 bar and most preferably 1 bar above normal atmospheric pressure. The pressure is generated by pumping inert gas through the gas inlet (2) and controlled by a pressure regulator (3) into the adhesive tank (1). The pressure can be determined by a manometer (4), which is in gas communication with the headspace (5) of the adhesive tank (1). The molten adhesive (6) inside the adhesive tank is maintained at application temperature by e.g. a melting grid (7). It is important to understand that the molten adhesive (6) is not foamed at this step like in foaming processes widely known in the art, e.g. in EP 72,679. The inert gas is not pumped into the molten adhesive (6) but into the headspace (5) of the adhesive tank (1) above the surface (8) of the molten adhesive (6). By the procedure of the present invention it is achieved that no substantial amount of inert gas used for pressurizing dissolves in the adhesive. The raised pressure achieved by the inert gas inhibits the formation of gas- bubbles in the molten adhesive (6) originating from volatiles. The pressurized molten adhesive (6) is then pumped by volumetric pumps (9) at a volumetric flow rate determined by the speed of rotation of the volumetric pump. To the exit of the volumetric pump an applicator device (10) can be fitted, which is e.g. a slot coater, a spray nozzle, a curtain coater, a single or multi bead coater, a spiral spray coater, a print applicator or the like equipment suitable for applying hot-melt adhesives to substrates. The raised pressure is released when the molten adhesive (6) passes the applicator device (10).

EXAMPLES

Example 1

Hot-melt adhesive containing superabsorbents (composition: 18% Estane T5410 from Noveon, 17% polyethylene glycol PEG-400 from Aldrich, 1% Irganox B225 from Ciba Geigy, 19% PM-17 from Savare and 45% Aquakeep 10SH-NF from Sumitomo) is melted between 135 and 155° C., in a bulk melter BM 200, available from Nordson, and pumped into a modified ITW Dynatech M25 adhesive tank with inlets for pumping air into it. The bulk melter was used to achieve faster melting of the adhesive. However it would be obvious to those skilled in the art that melting phase can be incorporated in the adhesive tank of the present invention, endowing the tank with a proper melting grid (see enclosed figure). The adhesive tank was heated to a temperature between 135 and 155° C., preferably at the same temperature of the bulk melter, under raised pressure of 0.5 bar above atmospheric pressure. The inert gas used for pressurizing is air, which is pumped into the adhesive tank by a conventional air compressor, in this example a GA 45 from Atlas Copco equipped with a dehumidifier FD 345 from the same supplier. The air was filtered in the compressor by filters MAC 17 abd MAA 17 from Fluka. A volumetric pump of the type Zenith, pumping 8.5 $cm^3$ per revolution, then pumps the pressurized molten adhesive at a constant adhesive flow rate determined by the speed of rotation of the volumetric pump.

For exemplary application to a substrate a slot coater of the type Nordson EP45-2 can be fitted to the exit of the volumetric pump. The adhesive is then applied through the slot coater onto a polyethylene film used in manufacturing absorbent articles, typically as backsheet material.

Example 2

The methodology used in this example is identical to the one used in Example 1, while the adhesive tank used was a Nordson Mx 4460 and the volumetric pump used was a Feinpruf, pumping 10 $cm^3$ per revolution.

Test Method for Determining the Mass Flow Rate of Molten Adhesive

The principle of the test is to (a) pump a certain volume of molten adhesive, which is determined by the speed of rotation of the volumetric pumps and a certain time interval of pumping, (b) to collect this volume of pumped adhesive and (c) to determine its weight. This is done by pumping molten hot-melt adhesive of the type disclosed in example 1 out of the adhesive tank by the volumetric pumps, wherein a hose is fitted to the exit of the pumps guiding the pumped adhesive into a vessel for collection. The vessel with the adhesive is weighted after the time interval of pumping has ended. When using the weight of the vessel itself as tara the weight of the pumped adhesive can be determined easily. For the purpose of this test the application temperature is the temperature at which the hot melt adhesive has a viscosity of 10000±2000 cps. The viscosity is measured according to the standard method ASTM D3236-88. For determining the influence of temperature on the mass flow rate of the molten adhesive said mass flow rate is determined at the application temperature as well as at 1° C. above and at 10° C. below said application temperature. All experiments described below were carried out three times for every temperature and the data presented below represent the mean value of these three experiments.

i) Measurements with Raised Pressure

For the following test the adhesive tank of example 1 being supplied with 2 volumetric pumps of the type used in example 1 was used. Two adhesive pumps, both having a pumping capacity of 8.5 ml per revolution, were operated at 29 rpm. The mass flow rate of the molten adhesive (composition see example 1) at a temperature of 135° C. at a pressure of 0.5 bar above normal air pressure was determined as about 604 g/min. Repeating the same pumping experiment at the application temperature of 145° C., an adhesive mass flow rate 622 g/min of was obtained. When repeating the same experiment at 155° C., 593 g/min was obtained as the adhesive mass flow rate. The variation of adhesive mass flow rate is thus about 2.9% when comparing the value for 135° C. with the one obtained at 145° C. ((604-622)/622 ·100) and 4.7% when comparing the values obtained at 145° C. and 155° C. ((593-622)/622·100). This demonstrates that the apparent density of the adhesive at the pump is of about 1.23 $g/cm^3$ at 135° C., about 1.26 $g/cm^3$ at 145° C. and about 1.2 $g/cm^3$ at 155° C. and thus being relatively independent from the temperature. Apparent density of the adhesive at the pump inlet is calculated by dividing the mass flow rate by the product of two times pump revolution speed and pump capacity, i.e. apparent density=604/(2·29·8.5)=1.23 $g/cm^3$ for 135° C. The raised pressure was achieved by air pressure originating from an air compressor.

ii) Measurements without Raised Pressure

When repeating the same experiment without the raised pressure while maintaining all other parameters unchanged about 592 g/min of molten adhesive mass flow rate were obtained at 135° C., for the application temperature of 145° C. a molten adhesive mass flow rate of 444 g/min were obtained, whereas about 345 g/min of molten adhesive mass flow rate were obtained at 155° C. The variation of the 135° C. value is thus 33% with respect to the 145° C. value, whereas the variation of the 155° C. value is 22% with respect to the 145° C. value. The calculated density of the molten adhesive at 135° C. is thus 1.2 $g/cm^3$, at 145° C. it is 0.9 $g/cm^3$ and at 155° C. it is 0.7 $g/cm^3$.

A variation of flow rate with temperature as observed in test runs ii) is not suitable to deliver constant product quality. This demonstrates that the raised pressure successfully inhibited the formation of gas bubbles and thus density variations in the pumped adhesive.

It has to be noted that in this example a high amount (45%) of superabsorbent particles was present in the adhesive, which means a significant source of adsorbed volatile material, i.e. water. Furthermore, the particle size (99.1% of the Aquakeep 10SH-NF superabsorbent particles used in the above tests had a particle size below 75 μm) of these particles was relatively low, which results in a high active surface of the superabsorbent material for releasing volatile material, i.e. water vapour. When considering all this the result of measurement (i) with raised pressure illustrates the successful suppression of gas bubbles originating from volatile material very well.

It is thus possible according to the present invention to pump molten hot-melt adhesives containing volatile material at a constant mass flow rate over a certain temperature range. This again allows application of such adhesives to substrates, such as constituents of absorbent articles like backsheets and the like, in a very constant and even manner.

While particular embodiments of the present invention have been illustrated and described, it would be obvious to those skilled in the art that various other changes and modifications can be made without departing from the scope of the invention. It is therefore intended to cover in the appended claims all such changes and modifications that are within the scope of this invention.

The invention claimed is:

1. Method of applying a molten hot-melt adhesive to a substrate, wherein said hot-melt adhesive comprises at least one volatile material having a boiling point at atmospheric pressure below the application temperature of said hot-melt adhesive, said method comprises the following steps:

(i) heating said hot-melt adhesive to its application temperature in an adhesive tank;

(ii) delivering said hot-melt adhesive from said adhesive tank at an adhesive mass flow rate, by using a delivering means;

wherein in that said steps (i) and (ii) are being carried out at a pressure of from about 0.05 to about 100 bar above atmospheric pressure for inhibiting the formation of gas bubbles originating from said volatile material, whereby said adhesive mass flow rate has a maximum variation of about ±10% in a temperature interval of about ±10° C. of said application temperature of 145° C. of said hot-melt adhesive.

2. The method of claim 1, wherein said adhesive mass flow rate has a maximum variation of about ±5 in a temperature interval of about ±10° C. of said application temperature of said hot-melt adhesive.

3. The method of claim 1, wherein said pressure is from about 0.1 to about 50 bar above atmospheric pressure.

4. The method of claim 1, wherein said adhesive tank is pressurized by an inert gas, such as air, carbon dioxide or nitrogen, which is pumped into the headspace of said adhesive tank above the surface of said hot-melt adhesive.

5. The method of claim 4, wherein said inert gas is put under pressure by a gas compressor.

6. The method of claim 1, wherein said hot-melt adhesive contains hygroscopic superabsorbent material.

7. The method of claim 1, wherein in said volatile material is water.

8. The method of claim 1, wherein said delivery means is a volumetric pump, which delivers a defined amount of said hot-melt adhesive per revolution.

9. The method of claim 1, wherein said adhesive mass flow rate has a maximum variation of about ±3% in a temperature interval of about ±10° C. of said application temperature of said hot-melt adhesive.

10. The method of claim 1, wherein said adhesive mass flow rate has a maximum variation of about ±1% in a temperature interval of about ±10° C. of said application temperature of said hot-melt adhesive.

11. The method of claim 1, wherein said pressure is from about 0.2 to about 10 bar above atmospheric pressure.

12. The method of claim 1, wherein said pressure is from about 0.3 to about 5 bar above atmospheric pressure.

13. The method of claim 1, wherein said pressure is from about 0.5 to about 3 bar above atmospheric pressure.

* * * * *

UNITED STATES PATENT AND TRADEMARK OFFICE

CERTIFICATE OF CORRECTION

PATENT NO. : 7,311,941 B2
APPLICATION NO. : 10/915741
DATED : December 25, 2007
INVENTOR(S) : Cesiro et al.

It is certified that error appears in the above-identified patent and that said Letters Patent is hereby corrected as shown below:

Column 10
Line 1, delete "1°" and insert --10°--.

Signed and Sealed this

Sixteenth Day of December, 2008

JON W. DUDAS
*Director of the United States Patent and Trademark Office*